US005876810A

United States Patent [19]

Bodine et al.

[11] Patent Number: 5,876,810

[45] Date of Patent: Mar. 2, 1999

[54] METHOD OF INSTALLING PANELS WITH FURRING TAPE AND THE RESULTING PANELED SURFACE

[75] Inventors: Darryl C. Bodine, Lancaster; William C. Dorsey, Conestoga, both of Pa.

[73] Assignee: Ethicon, Inc., Somerville, N.J.

[21] Appl. No.: 977,988

[22] Filed: Nov. 25, 1997

Related U.S. Application Data

[63] Continuation of Ser. No. 597,362, Feb. 8, 1996, abandoned.

[51] Int. Cl.[6] ..... B32B 31/00; E04B 2/00

[52] U.S. Cl. ..... 428/33; 428/99; 428/220; 156/71

[58] Field of Search ..... 156/71; 428/343, 428/41.7, 41.8, 220, 33, 99

[56] References Cited

U.S. PATENT DOCUMENTS

| | | | |
|---|---|---|---|
| 4,708,755 | 11/1987 | Lamblet | 156/71 |
| 4,965,943 | 10/1990 | Adams | 33/758 |
| 4,969,304 | 11/1990 | Helderman | 52/780 |

*Primary Examiner*—Jenna Davis
*Attorney, Agent, or Firm*—Hal Brent Woodrow

[57] ABSTRACT

The furring tape is a nominal 1" to 2" wide by 0.005" to 0.100" thick strip of plastic tape with a peel and stick adhesive on one face of the strip. The strip is adhered to drywall to grip staples used to secure ceiling tiles to the drywall.

8 Claims, 1 Drawing Sheet

METHOD OF INSTALLING PANELS WITH FURRING TAPE AND THE RESULTING PANELED SURFACE

This application is a continuation, of application Ser. No. 597,362 filed Feb. 8, 1996, now abandoned.

BACKGROUND OF THE INVENTION

1. Field of the Invention

The invention is directed to a method of installing panels with a tape structure, particularly for fastening panels, particular ceiling panels to a drywall surface with fastening means, particularly staples.

2. Description of the Prior Art

With drywall surfaces, wood furring strips are normally fastened to the drywall surface by nails that pierce the drywall to contact the studs or joists therebehind. Adhesive can be used to hold the wood furring strips to the drywall or adhesive can be used to directly fasten the ceiling panels to the drywall. When wood furring strips are used, staples normally fasten the ceiling panels to the furring strips.

The furring tape herein eliminates the cutting and nailing of wood furring strips or the mess of placing adhesive to the back of ceiling panels at the job site.

SUMMARY OF THE INVENTION

A ceiling furring tape with a peel and stick adhesive backing. The adhesive adheres the furring tape to the surface of a building. Ceiling panels are placed against the furring tape. Staples pass through the ceiling panels and are firmly held in the furring tape.

A new method of installing ceiling panels. The building surface to be covered with ceiling panels is of a material that does not readily grip conventional staples. The ceiling furring tape is adhered to the building surface. Ceiling panels are placed against the furring tape and staples hold the ceiling panels in place by passing through the ceiling panels and being firmly held in the furring tape.

DESCRIPTION OF THE PREFERRED EMBODIMENT

Figure 1:
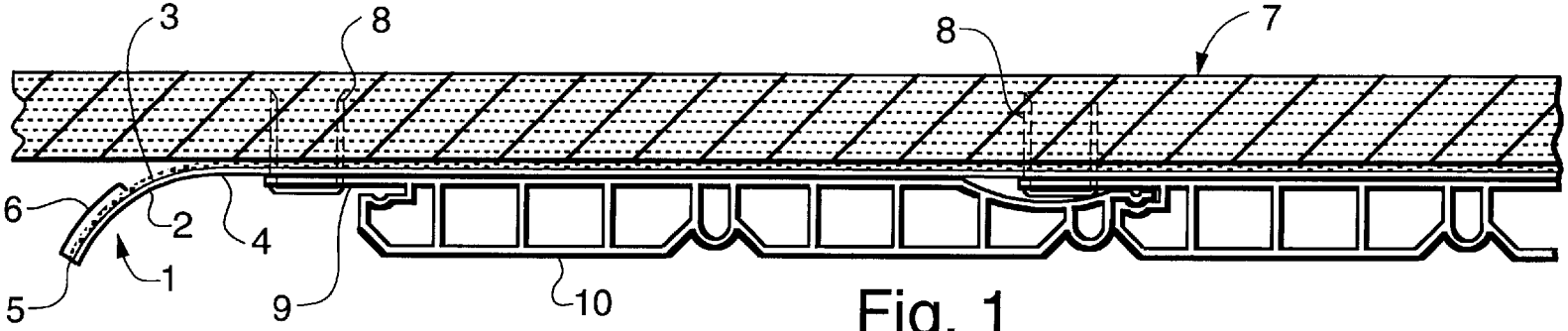
FIG. 1 is a side view of a ceiling panel mounted by the invention herein.
Figure 2:
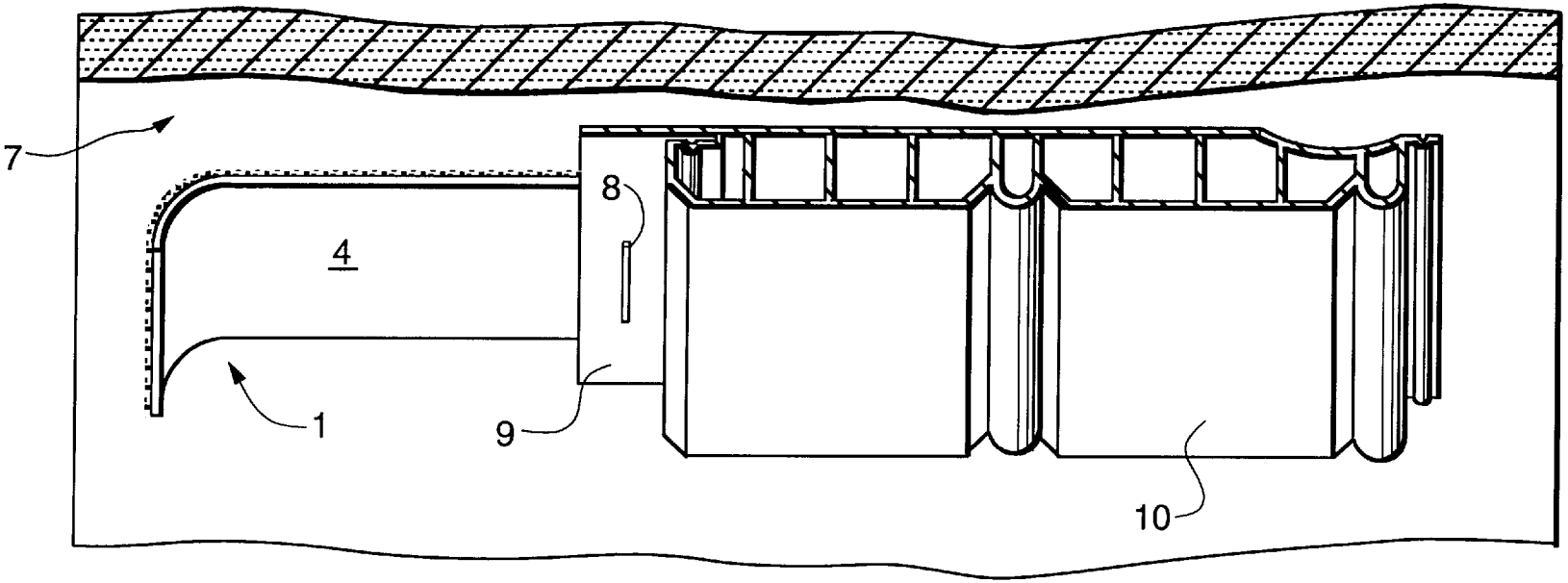
FIG. 2 is a front perspective view of the structure of FIG. 1.

The ceiling furring tape is an installation component used in place of wood furring strips or wet adhesives when staple-up ceiling tiles are to be installed onto a paper-gypsum (drywall, sheetrock, etc.) surface. Furring tape is fast and easy to install, does not create a dusty or sticky mess, is more economical than wood furring strips and ensures a maximum ceiling height.

Installing traditional wood furring strips requires that wood be cut with a saw and nailed or screwed into position and results in a ¾ loss of ceiling height. Wet adhesives (caulks or trowelable) are messy and have limited working time.

The ceiling furring tape would be positioned on the drywall ceiling in a layout similar to the recommended layout of wood furring strips and cut with a scissors or knife as needed and is bonded to the drywall with a peel and stick pressure sensitive adhesive. The application of furring tape results in only a minimal loss of ceiling height. Staples used to attach tiles to the ceiling puncture the furring tape and penetrate on into the drywall. The furring tape being unutilized to the drywall serves to prevent staples from working loose from the drywall. The invention would be available in tape rolls and pre-cut strips.

The ceiling furring tape 1 is a plastic strip 2 with an adhesive backing 3. The strip 2 could be a wood veneer strip or a good quality flexible paper strip, either of a thickness to firmly grip staples. The plastic strip in use is about one to two inches in width and about 0.005 to 0.100 inches in thickness.

The strip 2 has a front face 4 and back face 5. The back face has a conventional peel and stick adhesive layer with a protective layer 6. The protective layer 6 is peeled from the adhesive layer. The strip 2 is then adhered to the surface 7 of a building by the adhesive layer. The surface 7 of the building is normally drywall or any other material to which staples or nails will not readily adhere.

As shown in the drawings, staples 8 are used on the flanges 9 of the ceiling panel 10 to hold the ceiling panel in position on the building surface 7. Nails or other fastening means can be used in lieu of staples. Whatever fastening means is used, it must be firmly held in the plastic strip 2.

What is claimed is:

1. A method of installing panels onto a paper-gypsum surface element comprising the steps of:

a) supplying a paper-gypsum surface element to be covered with panels;

b) supplying a plastic strip and adhering the plastic strip to said paper-gypsum surface element;

c) supplying a plurality of panels, said panels having tongue and groove edges, and placing the panels against the plastic strip such that the plastic strip intersects the tongue and groove edges at a substantially perpendicular angle; and d) supplying panel fastening means and pressing panel fastening means through the grooved edge of the panel and the plastic strip, and into the surface element, whereby the plastic strip firmly grips the panel fastening means and the panel fastening means is hidden by the tongue edge of a second panel.

2. The method of installing panels as set forth in claim 1 wherein adhering the plastic strip to said surface element results from the further step of providing the plastic strip with a peel and stick adhesive layer.

3. The method of installing panels as set forth in claim 1 wherein the panel fastening means is a staple.

4. The method of installing panels as set forth in claim 1 wherein the panel fastening means is a nail.

5. A paneled surface system comprising a paper-gypsum surface element, a plastic furring tape, a plurality of panels and panel fastening means, said panels having tongue and groove edges, the plastic furring tape being adhered to the paper-gypsum surface element, the panel being placed against the plastic strip such that the plastic strip intersects the tongue and groove edges at a substantially perpendicular angle, the panel fastening means passing through the grooved edge of a first panel and the plastic furring tape and into the paper-gypsum surface element, whereby the plastic furring tape firmly grips the panel fastening means and the panel fastening means is hidden by the tongue edge of a second panel.

6. The paneled surface system of claim 5 wherein the plastic furring tape comprises a plastic strip about one to two inches in width and about 0.005 to 0.100 inches in thickness, the plastic strip having two faces, one face having a peel and stick adhesive which is an adhesive layer from which a protective layer has been peeled to permit the adhesive layer to adhere the plastic strip to a surface element, the other face of the plastic strip being adjacent the panel.

7. The paneled surface system of claim 5 wherein the fastening means is a staple.

8. The paneled surface system of claim 5 wherein the surface element is a drywall sheet.

* * * * *

UNITED STATES PATENT AND TRADEMARK OFFICE

CERTIFICATE OF CORRECTION

PATENT NO. : 5,876,810

DATED : March 2, 1999

INVENTOR(S) : Darryl C. Bodine et al.

It is certified that error appears in the above-identified patent and that said Letters Patent is hereby corrected as shown below:

Cover page, Item [73]Assignee, change "Ethicon, Inc., Somerville, N.J." to read --Armstrong World Industries, Inc., Lancaster, Pa.--;.

Col. 2, line 6-7, the word "unutilized" should read --unitized--.

Signed and Sealed this

Fifteenth Day of June, 1999

*Attest:*

*Attesting Officer*

Q. TODD DICKINSON

*Acting Commissioner of Patents and Trademarks*